US007311533B1

(12) United States Patent
Lin et al.

(10) Patent No.: US 7,311,533 B1
(45) Date of Patent: Dec. 25, 2007

(54) LIGHT SOCKET STRUCTURE

(75) Inventors: Mei-Ju Lin, Chung Ho (TW); Ming-Chou Kuo, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/637,873

(22) Filed: Dec. 13, 2006

(30) Foreign Application Priority Data

Oct. 12, 2006 (TW) ..... 95218011 U

(51) Int. Cl.
*H01R 13/44* (2006.01)

(52) U.S. Cl. ..... 439/131; 439/640

(58) Field of Classification Search ..... 439/131, 439/172, 640
See application file for complete search history.

(56) References Cited

U.S. PATENT DOCUMENTS 3,733,576 A * 5/1973 Cooper ..... 439/103
5,494,449 A * 2/1996 Chioo ..... 439/76.1
5,791,921 A * 8/1998 Lee ..... 439/172
5,967,807 A * 10/1999 Wu ..... 439/131
6,382,996 B1 * 5/2002 Eyman ..... 439/172
6,659,782 B2 * 12/2003 Wu ..... 439/131

* cited by examiner

*Primary Examiner*—Thanh-Tam Le
(74) *Attorney, Agent, or Firm*—Rosenberg, Klein & Lee

(57) ABSTRACT

A light socket structure includes a main body, a plug, a switch control element, and sockets. The plug is movably jointed with the main body. The switch control element is disposed on the main body for controlling the plug to be accommodated within or exposed out from the main body. The sockets are disposed in the main body, and each socket is electrically connected with the plug. In other words, when a user wants to use the light socket structure, he/she can control (by pressing or pulling) the switch control element to expose the plug's conductive terminals out from the main body. When the user does not want to use the light socket structure, he/she can manually push the plug's conductive terminals to return into the main body.

8 Claims, 7 Drawing Sheets

LIGHT SOCKET STRUCTURE

BACKGROUND OF THE INVENTION

1. Field of the Invention

The present invention relates to a light socket structure, and particularly relates to light socket structure for controlling a plug to be accommodated within or exposed from a main body of the light socket structure.

2. Description of the Related Art

Because of the convenience of electric power and the advancement of industrial technology, household electrical appliances acquire power via plugs plugged in sockets which are connected to municipal power grids. Hence, the use of the electric power has become indispensable to humans. However, because the use of electrical appliances is increasing and the number of sockets in a household or workplace is usually limited, adapters with multiple sockets have become a common solution to the lack of wall sockets.

In generally, prior art adapters with multiple sockets are comprised of a seat body, a pair of conductive pins disposed on a plug surface thereof, and more than two sets of conductive pin holes disposed on the other surface thereof to form a one-to-many expanded socket. Hence, when the pair of conductive pins of an adapter with multiple sockets is plugged into a wall socket, multiple electrical appliances can be plugged into the multiple sets of conductive pin holes.

SUMMARY OF THE INVENTION

The present invention provides a light socket structure. The light socket structure has a switch control element for controlling a plug to be accommodated within or exposed from a main body of the light socket structure. Hence, the light socket structure is portable. When a user wants to use the light socket structure, he/she can control (by pressing or pulling) the switch control element to expose the plug's conductive terminals out from the main body. When the user does not want to use the light socket structure, he/she can manually push the plug's conductive terminals to return into the main body.

A first aspect of the present invention is a light socket structure, comprising: a main body, a plug, a switch control element, and sockets. The plug is movably jointed with the main body. The switch control element is disposed on the main body for controlling the plug to be accommodated within or exposed out of the main body. The sockets are disposed in the main body, and each socket is electrically connected with the plug.

A second aspect of the present invention is a light socket structure, comprising a main body, a plug movably jointed with the main body, and a plurality of sockets electrically connected with the plug. The main feature is that a switch control element is disposed on the main body for controlling the plug to be accommodated within or exposed out from the main body.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED BEST MOLDS

Figure 1:
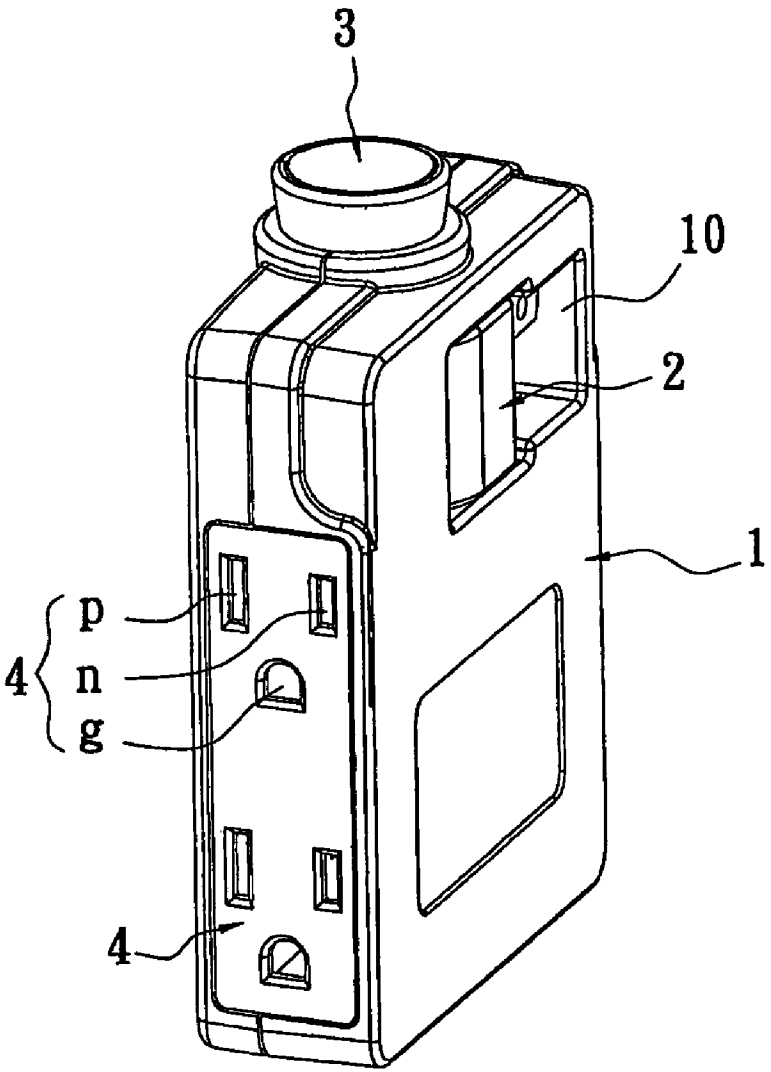
FIG. 1 is a perspective, assembled view of a light socket structure (when a plug of the light socket structure is turned off) according to the present invention.
Figure 2:
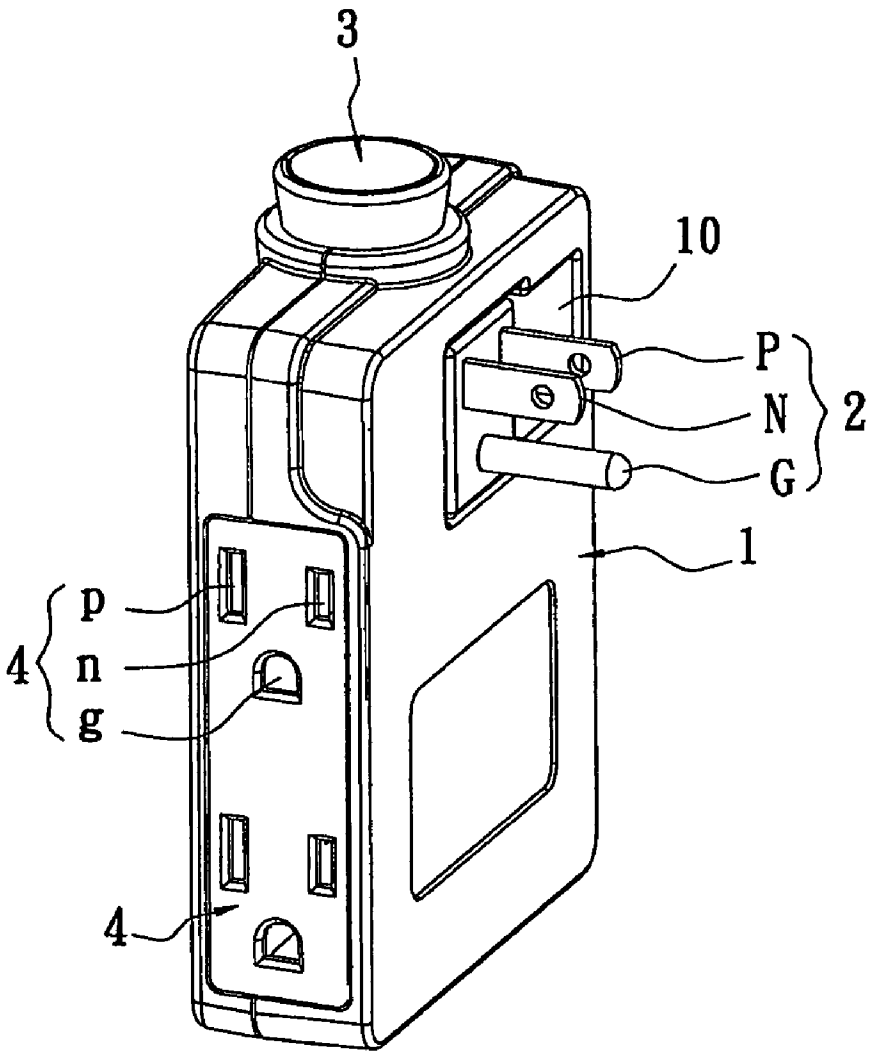
FIG. 2 is a perspective, assembled view of a light socket structure (when a plug of the light socket structure is turned on) according to the present invention.
Figure 3:
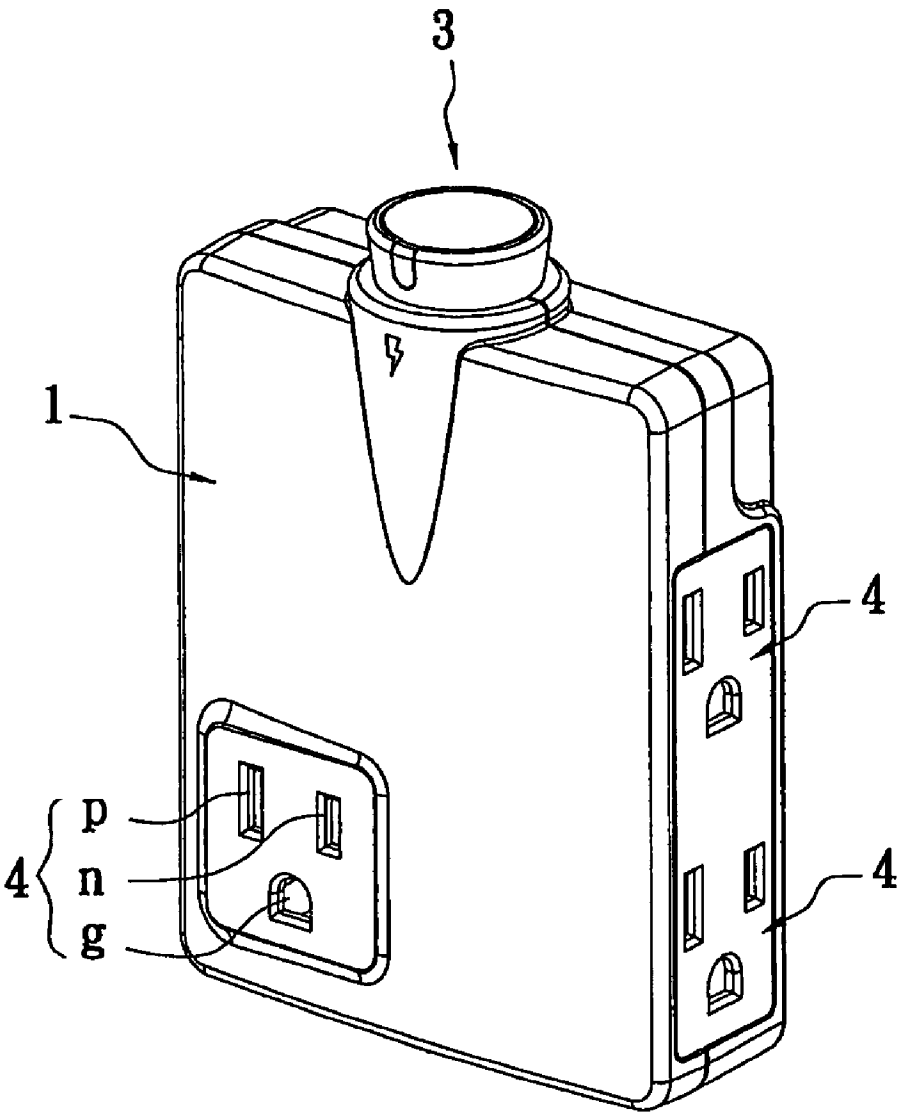
FIG. 3 is another view of a light socket structure according to the present invention.

Referring to FIGS. 1 to 3, the present invention provides a light socket structure, comprising: a main body 1, a plug 2, a switch control element 3, and a plurality of sockets 4.

The main body 1 has a concave groove 10. The plug 2 can be movably jointed with the main body 1. Hence, the plug 2 can be movably accommodated within or exposed out from the concave groove 10 of the main body 1. The switch control element 3 is disposed on the main body 1 in order to control the plug 2 to be accommodated within the main body 1 (as shown in FIG. 1) or be exposed out from the main body 1 (as shown in FIG. 2).

The sockets 4 are disposed in any position of the main body 1, and each socket 4 is electrically connected with the plug 2. In other words, each socket 4 has a positive terminal p and a negative terminal n electrically connected with a positive terminal P and a negative terminal N of the plug 2, respectively. In addition, each socket 4 has a ground terminal g electrically connected with a ground terminal G of the plug 2.

Figure 4:
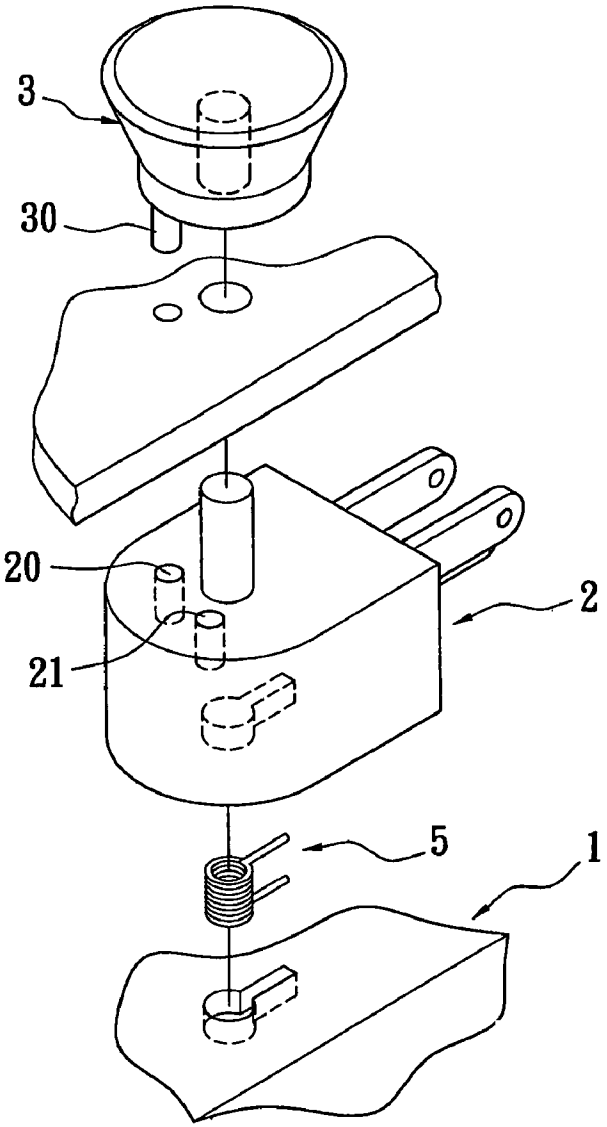
FIG. 4 is a partially exploded, schematic view of a light socket structure according to the first embodiment of the present invention.
Figure 6:
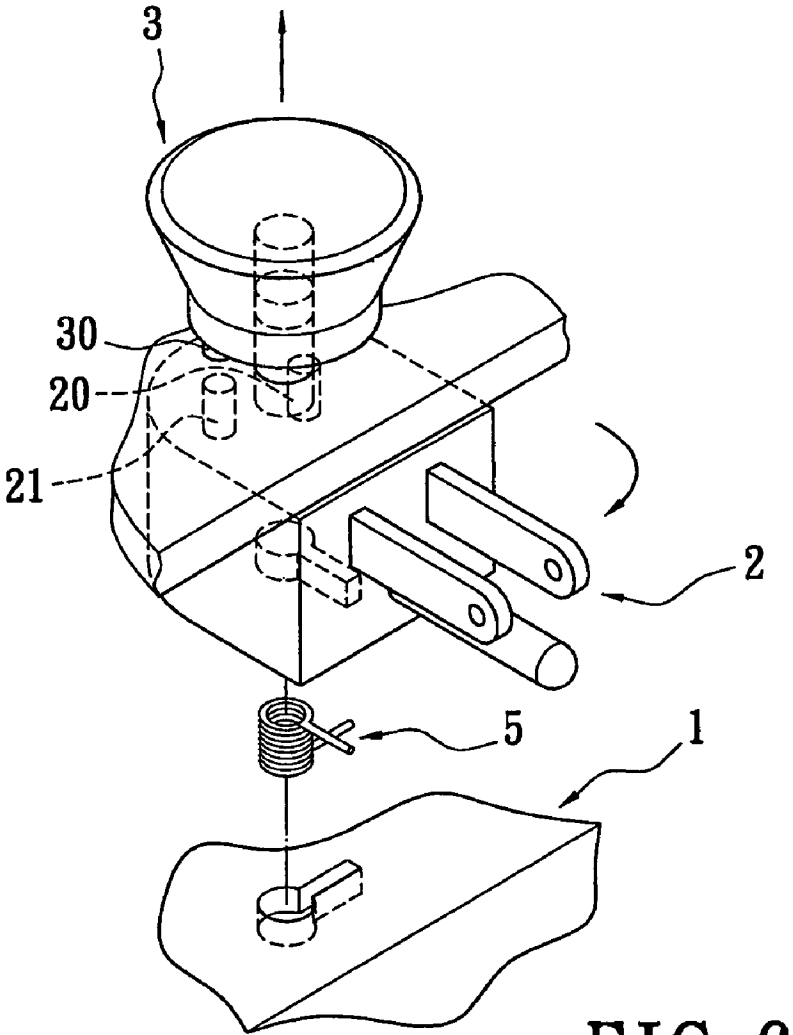
FIG. 6 is a partially assembled, schematic view of a light socket structure (when a plug of the light socket structure is turned on) according to the first embodiment of the present invention.
Figure 5:
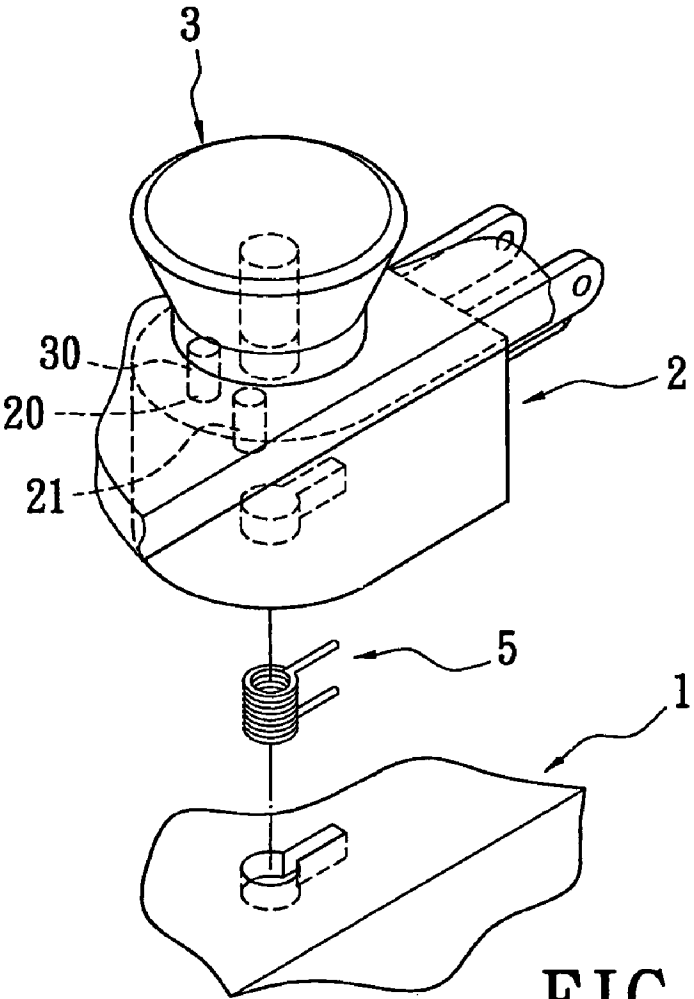
FIG. 5 is a partially assembled, schematic view of a light socket structure (when a plug of the light socket structure is turned off) according to the first embodiment of the present invention.
Figure 7:
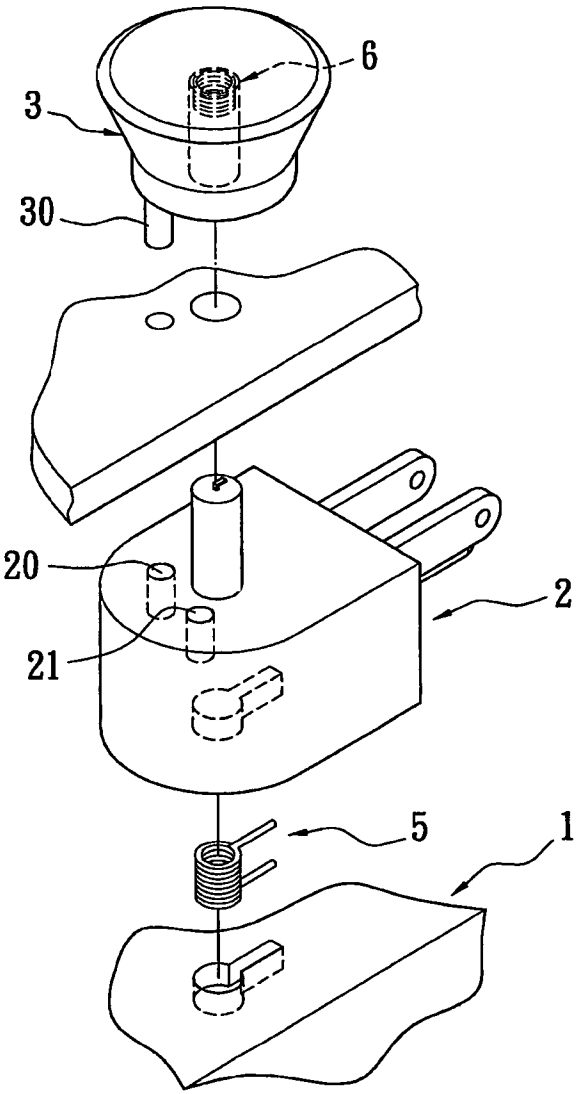
FIG. 7 is a partially exploded, schematic view of a light socket structure according to the second embodiment of the present invention.

Referring to FIGS. 4 to 6, the light socket structure of the present invention further comprises an elastic element 5 disposed between the plug 2 and the main body 1. One side of the elastic element 5 is embedded in the plug 2 and the other side of the elastic element 5 is embedded in the main body 1. In addition, the elastic element 5 can be a torsion spring.

Moreover, the switch control element 3 has a bolt 30, and the plug 2 has two receiving holes 20, 21 for selectively accommodating the bolt 30. In other words, when the bolt 30 is accommodated within the receiving hole 20, the plug 2 is locked in the main body 1 (as shown in FIG. 5). When the switch control element 3 is pulled upwardly in the direction of the arrow (as shown in FIG. 6), the plug 2 is sprung out from the main body 1 via the torsion force of the elastic element 5 (as shown in FIG. 6). Finally, the switch control element 3 is pulled downward and the bolt 30 is accommodated within the receiving hole 21 in order to lock the plug 2.

Moreover, when the plug 2 needs to be accommodated within the main body 1, the switch control element 3 is pulled upward and then the plug 2 is pushed into the main body 1. Finally, the switch control element 3 is pulled downward and the bolt 30 is accommodated within the receiving hole 20 in order to lock the plug 2 into the main body 1 (as shown in FIG. 5).

Referring to FIGS. 7 to 10, the difference between the second embodiment and the first embodiment is that in the second embodiment the present invention further comprises an elastic element 6 disposed between the switch control element 3 and the plug 2. One side of the elastic element 6 is embedded in the switch control element 3 and the other side of the elastic element 6 is jointed with the plug 2. In addition, the elastic element 6 can be a compression spring.

Figure 10:
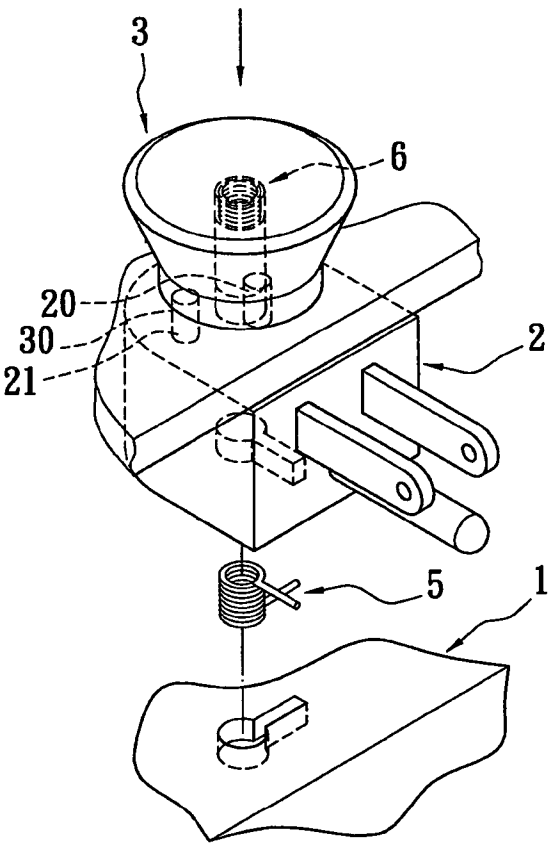
FIGS. 9 to 10 are two partially assembled, schematic views of a light socket structure (when a plug of the light socket structure is turned on) according to the second embodiment of the present invention.
Figure 9:
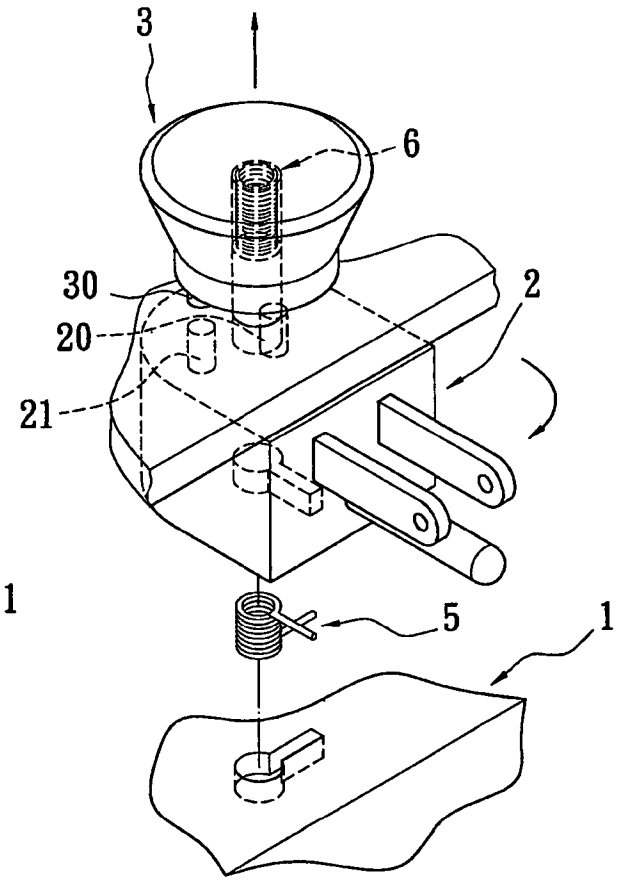
Figure 8:
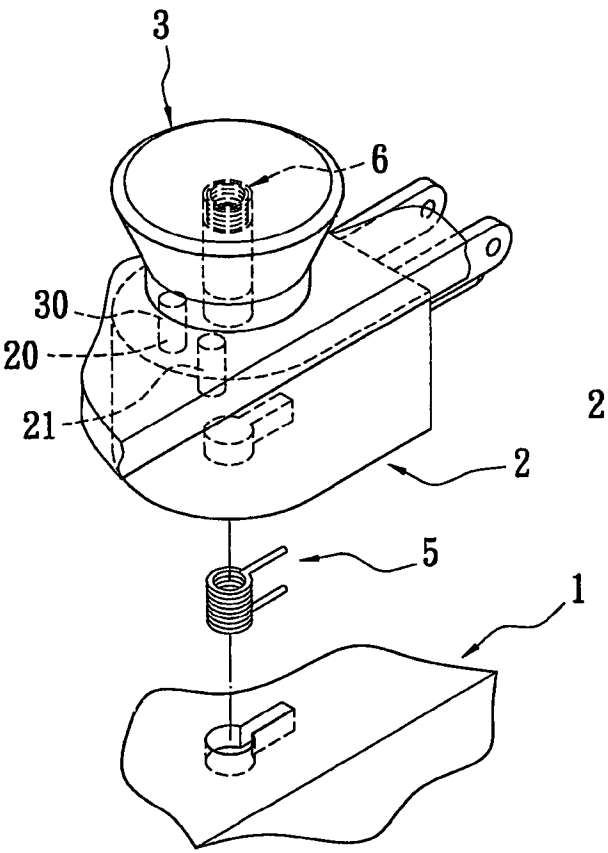
FIG. 8 is a partially assembled, schematic view of a light socket structure (when a plug of the light socket structure is turned off) according to the second embodiment of the present invention.

Hence, in the second embodiment, the switch control element 3 can be automatically pulled back via the elastic element 6 (as shown in FIGS. 9-10). In the second embodiment the switch control element 3 does not need to be manually pulled back as in the first embodiment.

Furthermore, the plug 2 accommodated within or exposed out from the main body 1 is not only by pulling/pushing (such as the first embodiment) or pulling (such as the second embodiment) the switch control element 3. Any other methods for accommodating the plug 2 within or exposing the plug 2 out from the main body 1 (such as pressing the switch control element 3 to accommodate the plug 2 within or exposed the plug 2 out from the main body 1) are protected in the present invention.

In conclusion, the light socket structure uses the switch control element 3 to control the plug 2 to be accommodated within or exposed out from the main body 1. Hence, the present invention is portable. Furthermore, when a user wants to use the light socket structure, he/she can control (by pressing or pulling) the switch control element 3 to expose the plug's conductive terminals (P, N, G) out from the main body 1. When the user does not want to use the light socket structure, he/she can manually push the plug's conductive terminals (P, N, G) to return into the main body 1.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light socket structure, comprising:

a main body having an aperture;

a plug pivotally mounted within the main body having two receiving holes;

a switch control element disposed on the main body for selectively controlling the plug to be accommodated within or protruding outwardly from the main body, said switch control element having a bolt attached thereto, said bolt passing through said aperture in said main body and selectively engaging in one of the two receiving holes responsive to said switch control element being moved in a downward longitudinal direction for securely locking said plug and moved in an upward longitudinal direction for releasing said plug, either within or protruding outwardly from said main body respectively; and a plurality of sockets disposed in the main body, wherein each socket is electrically connected with the plug.

2. The light socket structure as claimed in claim 1, further comprising an elastic element disposed between the plug and the main body, wherein one side of the elastic element is embedded in the plug and the other side of the elastic element is embedded in the main body.

3. The light socket structure as claimed in claim 2, wherein the elastic element is a torsion spring.

4. The light socket structure as claimed in claim 1, further comprising an elastic element disposed between the switch control element and the plug, wherein one side of the elastic element is embedded in the switch control element and the other side of the elastic element is jointed with the plug.

5. The light socket structure as claimed in claim 4, wherein the elastic element is a compression spring.

6. The light socket structure as claimed in claim 1, wherein the main body has a concave groove, and the plug is movably accommodated within or exposed out from the concave groove of the main body.

7. The light socket structure as claimed in claim 1, wherein each socket has a positive terminal and a negative terminal electrically connected with the plug's positive and negative terminals, respectively.

8. The light socket structure as claimed in claim 1, wherein each socket has a ground terminal electrically connected with the plug's ground terminal.

* * * * *